US009931638B2

(12) United States Patent
Stewart

(10) Patent No.: US 9,931,638 B2
(45) Date of Patent: Apr. 3, 2018

(54) GARBAGE DISPOSAL CLEANING SYSTEM

(71) Applicant: Latonya Stewart, Newbury Park, CA (US)

(72) Inventor: Latonya Stewart, Newbury Park, CA (US)

( * ) Notice: Subject to any disclaimer, the term of this patent is extended or adjusted under 35 U.S.C. 154(b) by 99 days.

(21) Appl. No.: 15/052,870

(22) Filed: Feb. 24, 2016

(65) Prior Publication Data

US 2017/0238691 A1 Aug. 24, 2017

(51) Int. Cl.

| | |
|---|---|
| ***B02C 18/00*** | (2006.01) |
| ***A46B 13/02*** | (2006.01) |
| ***A46B 13/00*** | (2006.01) |
| ***A46B 11/00*** | (2006.01) |

(52) U.S. Cl.

CPC ..... *B02C 18/0084* (2013.01); *A46B 11/002* (2013.01); *A46B 13/001* (2013.01); *A46B 13/02* (2013.01); *B02C 18/0092* (2013.01)

(58) Field of Classification Search

CPC . B02C 18/0084; B02C 18/0092; A46B 13/02; A46B 13/001; A46B 11/002

USPC ..... 241/46.013, 101.2; 15/160, 101.32, 15/101.31; 4/255.11

See application file for complete search history.

(56) References Cited

U.S. PATENT DOCUMENTS 3,026,552 A 3/1962 Price
4,409,692 A * 10/1983 Ness ..... A47L 17/02 15/105
4,480,795 A * 11/1984 Pellegrino ..... B08B 7/02 241/167
4,852,813 A * 8/1989 Brackett ..... B02C 23/00 241/30
4,955,657 A * 9/1990 Ward ..... B25B 7/00 15/257.01
5,353,461 A 10/1994 Enriquez
5,377,362 A * 1/1995 Jackson ..... A46B 15/00 15/160
5,423,621 A * 6/1995 Russell ..... A46B 11/0013 15/160
5,617,605 A * 4/1997 Hoerner ..... A46B 5/02 15/105
5,635,400 A 6/1997 Brenner
6,047,432 A * 4/2000 Sode ..... E03C 1/30 15/160
6,170,107 B1 1/2001 George et al.
6,827,794 B2 * 12/2004 Sommerfeld, Sr. ..... A46B 3/18 134/8
D504,749 S 5/2005 Habib
7,260,862 B1 8/2007 deFilippis
7,367,078 B2 * 5/2008 Mameletzi ..... A47L 17/04 15/105

(Continued)

FOREIGN PATENT DOCUMENTS

WO WO2009147655 12/2009

*Primary Examiner* — Faye Francis

(57) ABSTRACT

A garbage disposal cleaning system includes a garbage disposal that may be fluidly coupled to a drain on a sink. A scrubbing unit is removably positioned within the garbage disposal. The scrubbing unit frictionally engages the garbage disposal. The scrubbing unit contains and releases a detergent. The scrubbing unit cleans the garbage disposal when the garbage disposal is turned on. Thus, the scrubbing unit may reduce an odor relating to bacterial decay in the garbage disposal.

5 Claims, 4 Drawing Sheets

(56) References Cited

U.S. PATENT DOCUMENTS

| | | | | |
|---|---|---|---|---|
| 7,673,364 | B2 * | 3/2010 | Dombrowski | E03C 1/26 15/105 |
| 7,676,879 | B1 | 3/2010 | Rutenberg et al. | |
| 7,971,309 | B2 * | 7/2011 | Houck | E03C 1/264 15/105 |
| 8,365,343 | B2 * | 2/2013 | Sherwood | B08B 1/00 15/104.001 |
| 2007/0294858 | A1 * | 12/2007 | Murphy | A47L 7/0028 15/353 |
| 2009/0094766 | A1 * | 4/2009 | Dombrowski | E03C 1/264 15/105 |
| 2012/0011671 | A1 * | 1/2012 | Houck | E03C 1/266 15/105 |
| 2012/0126045 | A1 | 5/2012 | Bradley et al. | |

* cited by examiner

GARBAGE DISPOSAL CLEANING SYSTEM

BACKGROUND OF THE DISCLOSURE

Field of the Disclosure

The disclosure relates to cleaning devices and more particularly pertains to a new cleaning device for cleaning an interior of a garbage disposal.

SUMMARY OF THE DISCLOSURE

An embodiment of the disclosure meets the needs presented above by generally comprising a garbage disposal that may be fluidly coupled to a drain on a sink. A scrubbing unit is removably positioned within the garbage disposal. The scrubbing unit frictionally engages the garbage disposal. The scrubbing unit contains and releases a detergent. The scrubbing unit cleans the garbage disposal when the garbage disposal is turned on. Thus, the scrubbing unit may reduce an odor relating to bacterial decay in the garbage disposal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
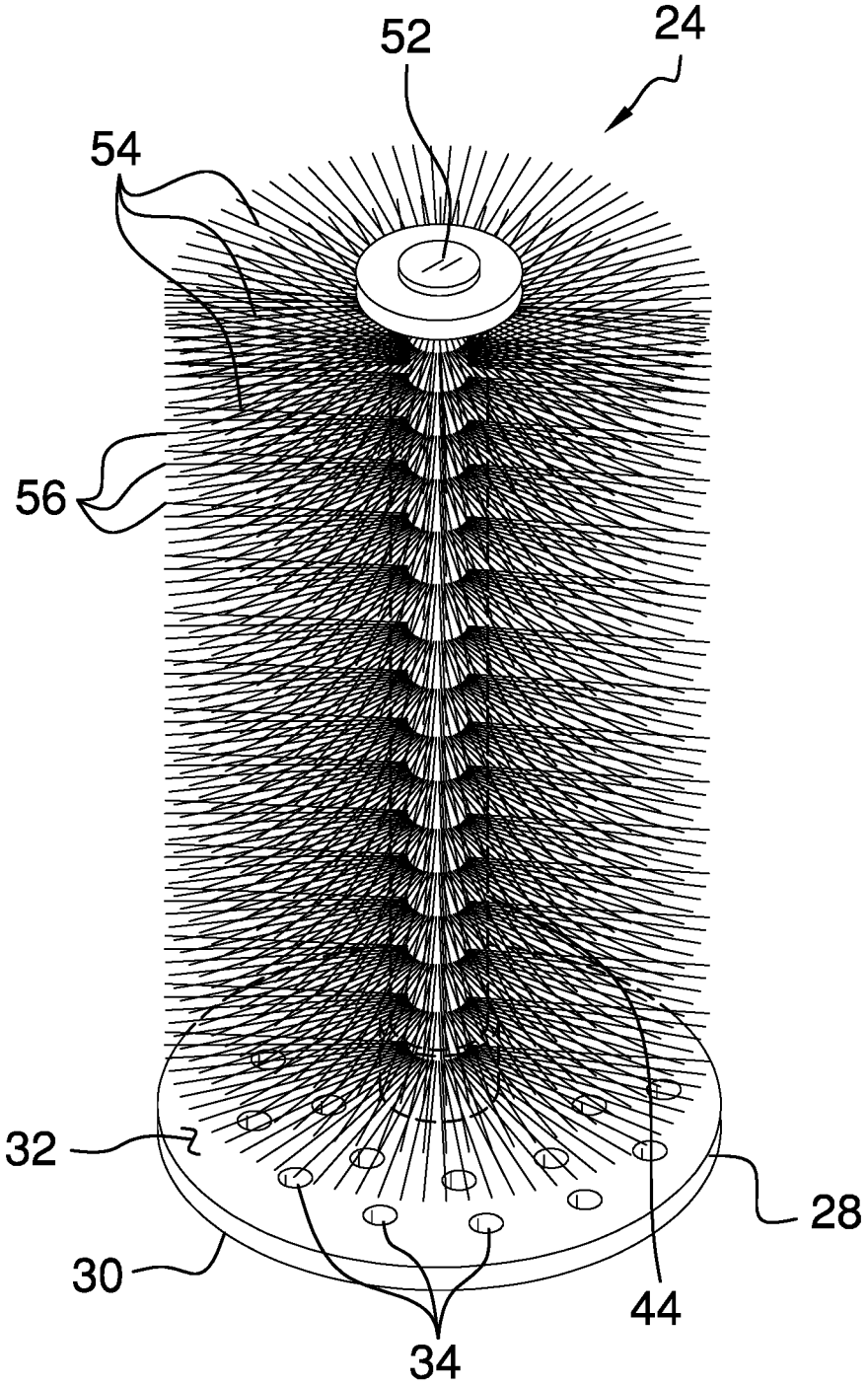
FIG. 1 is a front perspective view of a garbage disposal cleaning system according to an embodiment of the disclosure.
Figure 2:
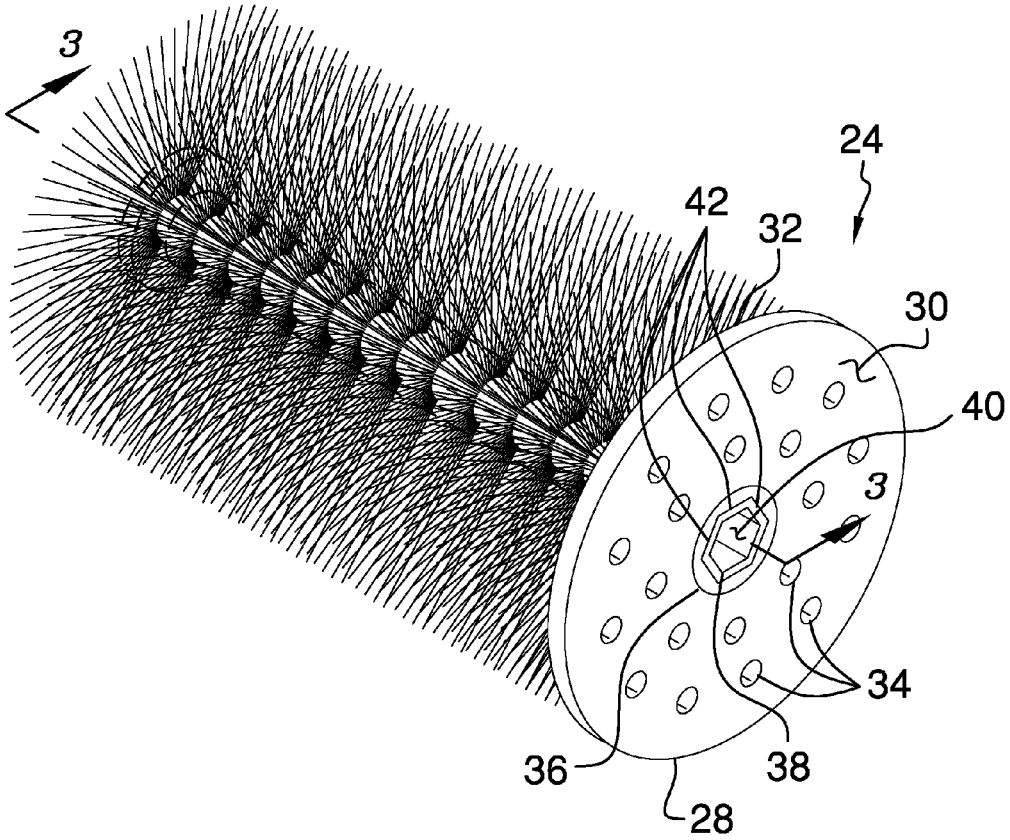
FIG. 2 is a bottom perspective view of an embodiment of the disclosure.
Figure 4:
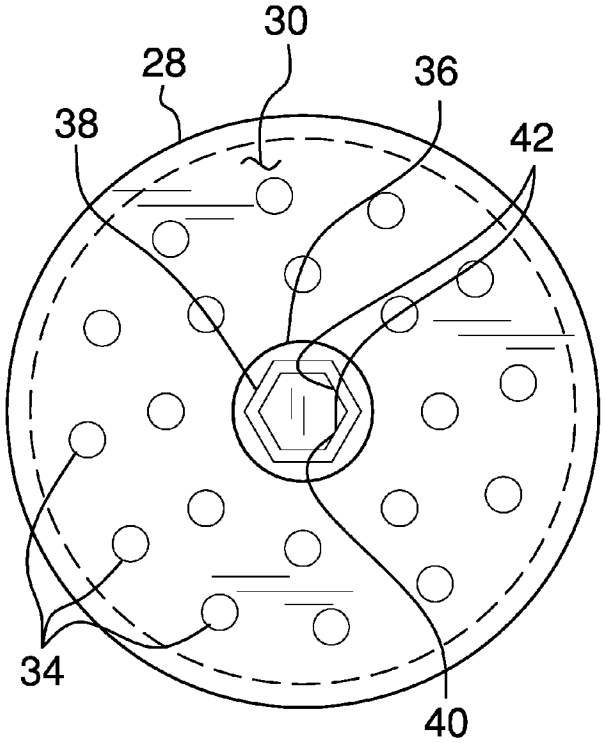
FIG. 4 is a bottom view of an embodiment of the disclosure.
Figure 3:
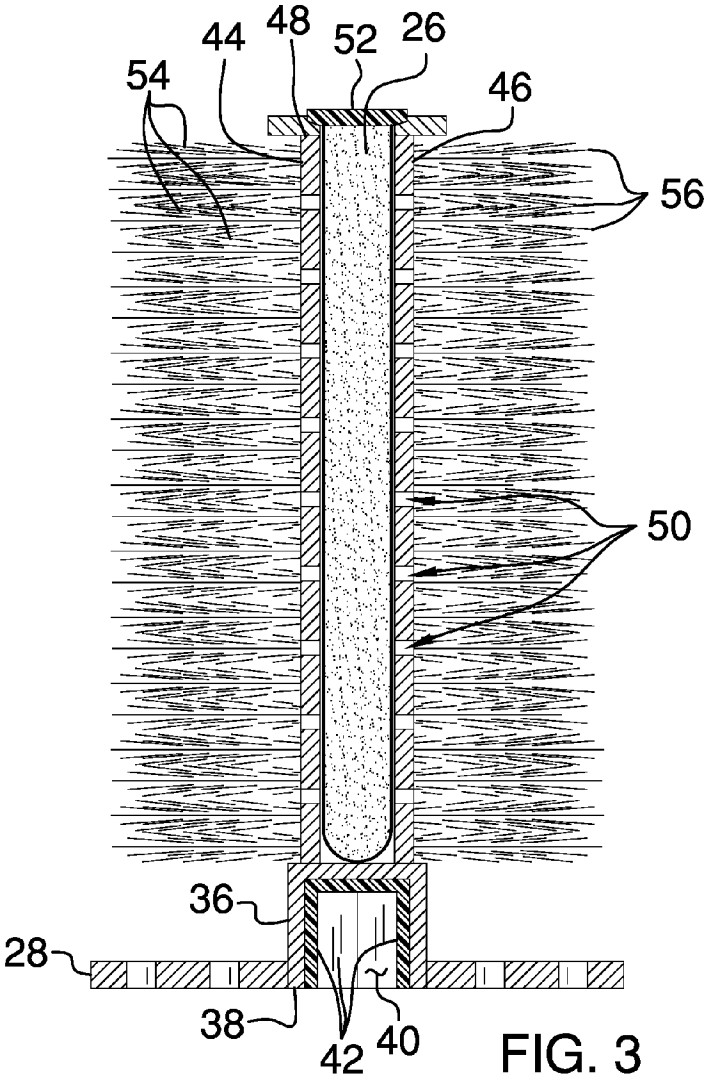
FIG. 3 is a cross sectional view taken along line 3-3 of FIG. 2 of an embodiment of the disclosure.
Figure 5:
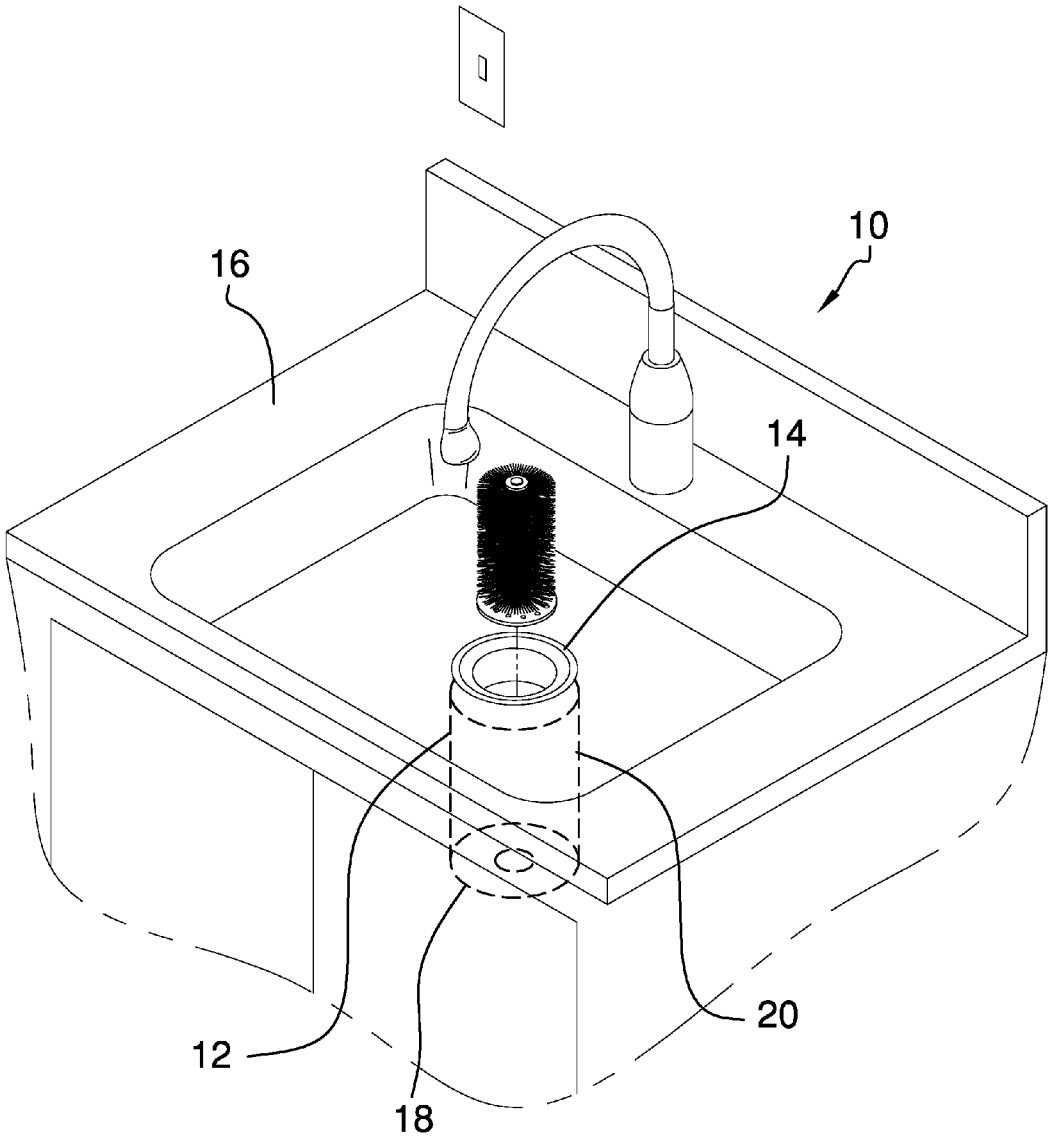
FIG. 5 is a perspective in-use view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the garbage disposal cleaning system 10 generally comprises a garbage disposal 12 that may be fluidly coupled to a drain 14 on a sink 16. The garbage disposal 12 has a bottom wall 18 and a perimeter wall 20. The garbage disposal 12 includes a bolt 22 that is coupled to the bottom wall 18. The garbage disposal 12 may comprise an electric garbage disposal or the like. The sink 16 may comprise a kitchen sink or the like.

A scrubbing unit 24 is provided. The scrubbing unit 24 is removably positioned within the garbage disposal 12 such that the scrubbing unit 24 frictionally engages the perimeter wall 20. The scrubbing unit 24 contains and releases a detergent 26. The detergent 26 may comprise a liquid soap or the like. The scrubbing unit 24 cleans the garbage disposal 12 when the garbage disposal 12 is turned on. Thus, the scrubbing unit 24 may reduce an odor relating to bacterial decay in the garbage disposal 12.

The scrubbing unit 24 comprises a disk 28 that has a bottom surface 30 and a top surface 32. The disk 28 has a plurality of apertures 34 extending through the top surface 32 and the bottom surface 30. Each of the apertures 34 allows water to pass through the disk 28. The bottom surface 30 of the disk 28 abuts the bottom wall 18 of the garbage disposal 12 when the scrubbing unit 24 is positioned in the garbage disposal 12.

A coupler 36 extends through the top surface 32 and the bottom surface 30 of the disk 28. The coupler 36 is centrally positioned on the disk 28. The coupler 36 has an open end 38 and the open end 38 is aligned with the bottom surface 30. The open end 38 has an inner surface 40 and the inner surface 40 has a plurality of intersecting sides 42. Each of the intersecting sides 42 frictionally engages the bolt 22 in the garbage disposal 12 such that the disk 28 is removably coupled to the garbage disposal 12. The garbage disposal 12 rotates the disk 28 when the garbage disposal 12 is turned on.

A tube 44 is coupled to and extends upwardly from the top surface 32 of the disk 28. The tube 44 has an outer wall 46 and a distal end 48 with respect to the disk 28. The distal end 48 is open to receive the detergent 26. The tube 44 is substantially hollow.

The tube 44 has a plurality of openings 50 and each of the openings 50 extends through the outer wall 46. Each of the openings 50 releases the detergent 26 when the garbage disposal 12 rotates the disk 28. The detergent 26 is released from the tube 44 through centrifugal force. The openings 50 are spaced apart from each other and are distributed around the tube 44.

A cap 52 is removably coupled to the distal end 48 of the tube 44. A plurality of bristles 54 is provided. Each of the bristles 54 is coupled to and extends outwardly from the outer wall 46 of the tube 44. Each of the bristles 54 has a distal end 56 with respect to the outer wall 46. The distal end 56 corresponding to each of the bristles 54 frictionally engages the perimeter wall 20 of the garbage disposal 12 when the scrubbing unit 24 is positioned in the garbage disposal 12. The bristles 54 are spaced apart from each other and distributed around the tube 44. The detergent 26 is distributed onto the bristles 54 when detergent 26 is released from the tube 44.

In use, the detergent 26 is poured into the distal end 48 of the tube 44 and the cap 52 is removably coupled to the tube 44. The scrubbing unit 24 is inserted through the drain 14 such that the coupler 36 engages the bolt 22 in the garbage disposal 12. The garbage disposal 12 is turned on. The garbage disposal 12 rotates the scrubbing unit 24 and the bristles 54 scrub the perimeter wall 20 of the garbage disposal 12. The sink 16 is turned on to direct a flow of water into the garbage disposal 12 while the scrubbing unit 24 scrubs the garbage disposal 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage disposal cleaning system comprising:

a garbage disposal being configured to be fluidly coupled to a drain on a sink, said garbage disposal has a bottom wall and a perimeter wall, said garbage disposal including a bolt being coupled to said bottom wall; and a scrubbing unit being removably positioned within said garbage disposal such that said scrubbing unit frictionally engages said garbage disposal, said scrubbing unit being configured to contain and release a detergent, said scrubbing unit cleaning said garbage disposal when said garbage disposal is turned on wherein said scrubbing unit is configured to reduce an odor relating to bacterial decay in said garbage disposal, said scrubbing unit comprising a disk having a bottom surface and a top surface, said disk having a plurality of apertures extending through said top surface and said bottom surface, and a coupler extending through said top surface and said bottom surface of said disk, said coupler being centrally positioned on said disk, said coupler having an open end, said open end being aligned with said bottom surface, said open end having an inner surface, said inner surface having a plurality of intersecting sides, each of said intersecting sides frictionally engaging said bolt in said garbage disposal such that said disk is removably coupled to said garbage disposal, said garbage disposal rotating said disk when said garbage disposal is turned on.

2. The system according to claim 1, further comprising:

a disk having a top surface; and a tube being coupled to and extending upwardly from said top surface of said disk, said tube having an outer wall and a distal end with respect to said disk, said distal end being open wherein said distal end is configured to receive the detergent, said tube being substantially hollow.

3. The system according to claim 2, wherein said tube has a plurality of openings, each of said openings extending through said outer wall wherein each of said openings is configured to release the detergent when said garbage disposal rotates said disk, said openings being spaced apart from each other and being distributed around said tube.

4. A garbage disposal cleaning system comprising:

a garbage disposal being configured to be fluidly coupled to a drain on a sink;

a scrubbing unit being removably positioned within said garbage disposal such that said scrubbing unit frictionally engages said garbage disposal, said scrubbing unit being configured to contain and release a detergent, said scrubbing unit cleaning said garbage disposal when said garbage disposal is turned on wherein said scrubbing unit is configured to reduce an odor relating to bacterial decay in said garbage disposal;

a disk having a top surface;

a tube being coupled to and extending upwardly from said top surface of said disk, said tube having an outer wall and a distal end with respect to said disk, said distal end being open wherein said distal end is configured to receive the detergent, said tube being substantially hollow, said tube has a plurality of openings, each of said openings extending through said outer wall wherein each of said openings is configured to release the detergent when said garbage disposal rotates said disk, said openings being spaced apart from each other and being distributed around said tube; and a plurality of bristles, each of said bristles being coupled to and extending outwardly from said outer wall of said tube, each of said bristles having a distal end with respect to said outer wall, said distal end corresponding to each of said bristles frictionally engaging a perimeter wall of said garbage disposal when said scrubbing unit is positioned in said garbage disposal, said bristles being spaced apart from each other and distributed around said tube.

5. A garbage disposal cleaning system comprising:

a garbage disposal being configured to be fluidly coupled to a drain on a sink, said garbage disposal having a bottom wall and a perimeter wall, said garbage disposal including a bolt being coupled to said bottom wall; and a scrubbing unit being removably positioned within said garbage disposal such that said scrubbing unit frictionally engages the perimeter wall, said scrubbing unit being configured to contain and release a detergent, said scrubbing unit cleaning said garbage disposal when said garbage disposal is turned on wherein said scrubbing unit is configured to reduce an odor relating to bacterial decay in said garbage disposal, said scrubbing unit comprising:

a disk having a bottom surface and a top surface, said disk having a plurality of apertures extending through said top surface and said bottom surface, a coupler extending through said top surface and said bottom surface of said disk, said coupler being centrally positioned on said disk, said coupler having an open end, said open end being aligned with said bottom surface, said open end having an inner surface, said inner surface having a plurality of intersecting sides, each of said intersecting sides frictionally engaging said bolt in said garbage disposal such that said disk is removably coupled to said garbage disposal, said garbage disposal rotating said disk when said garbage disposal is turned on, a tube being coupled to and extending upwardly from said top surface of said disk, said tube having an outer wall and a distal end with respect to said disk, said distal end being open wherein said distal end is configured to receive the detergent, said tube being substantially hollow, said tube having a plurality of openings, each of said openings extending through said outer wall wherein each of said openings is configured to release the detergent when said garbage disposal rotates said disk, said openings being spaced apart from each other and being distributed around said tube, a cap being removably coupled to said distal end of said tube, and a plurality of bristles, each of said bristles being coupled to and extending outwardly from said outer wall of said tube, each of said bristles having a distal end with respect to said outer wall, said distal end corresponding to each of said bristles frictionally engaging said perimeter wall of said garbage disposal when said scrubbing unit is positioned in said garbage disposal, said bristles being spaced apart from each other and distributed around said tube.

* * * * *